United States Patent [19]

Anderson et al.

[11] Patent Number: 4,707,953

[45] Date of Patent: Nov. 24, 1987

[54] EXPANDABLE SHELTER SYSTEM PROVIDING COLLECTIVE PROTECTION

[75] Inventors: Robert D. Anderson, Orlando; John D. Estes, DeLand; John Carta, Maitland, all of Fla.; Gilbert J. Page, Baltimore, Md.

[73] Assignee: Brunswick Corporation, Skokie, Ill.

[21] Appl. No.: 790,132

[22] Filed: Oct. 22, 1985

Related U.S. Application Data

[63] Continuation-in-part of Ser. No. 480,230, Mar. 30, 1983, abandoned.

[51] Int. Cl.[4] ..... E04B 1/12; G08B 21/00

[52] U.S. Cl. ..... 52/63; 52/2; 340/626

[58] Field of Search ..... 52/63, 2; 340/626

[56] References Cited

U.S. PATENT DOCUMENTS

| | | | |
|---|---|---|---|
| 2,649,101 | 8/1953 | Suits | 52/2 |
| 2,834,953 | 5/1958 | Bechberger et al. | 340/626 |
| 2,910,994 | 11/1959 | Joy | 52/2 |
| 2,948,286 | 8/1960 | Turner | 52/2 |
| 3,006,352 | 10/1961 | Hozak | 52/2 |
| 3,113,403 | 12/1963 | MacMillan, Jr. et al. | 52/63 |
| 3,299,645 | 1/1967 | Link | 52/2 |
| 3,314,198 | 4/1967 | Frisk | 52/2 |
| 3,328,926 | 7/1967 | Reinhard | 52/63 |
| 3,464,168 | 9/1969 | Russell et al. | 52/63 |
| 3,563,257 | 2/1971 | Cummins | 52/63 |
| 3,769,763 | 11/1973 | Kwake | 52/2 |
| 3,810,262 | 5/1974 | Strand | 52/2 |
| 3,914,755 | 10/1975 | Hook | 340/626 |
| 4,101,001 | 7/1978 | Smith | 340/626 |
| 4,106,002 | 8/1978 | Hogue, Jr. | 340/626 |
| 4,275,393 | 6/1981 | Johnston | 340/626 |
| 4,316,176 | 2/1982 | Gee et al. | 340/626 |
| 4,425,929 | 1/1984 | Von Mosshaim | 52/63 |

FOREIGN PATENT DOCUMENTS

| | | | |
|---|---|---|---|
| 1007949 | 4/1977 | Canada | 52/63 |
| 1326011 | 8/1973 | United Kingdom | 52/63 |

OTHER PUBLICATIONS

"Structures for Industry"; 1973, 1975, Irvin Industries Inc.

*Primary Examiner*—William F. Pate, III
*Assistant Examiner*—Michael Safavi
*Attorney, Agent, or Firm*—William G. Lawler, Jr.; George J. Porter

[57] ABSTRACT

A lightweight, free-standing, expandable shelter (10) providing protection against chemical and biological agents and against nuclear fallout. The shelter (10) has a frame comprising a series of U-shaped ribs (12) spaced and held parallel by a series of reinforcing members (16) connecting each adjacent pair of ribs (12) on each side of the shelter (10). A cover (11) made of flexible material which is resistant to chemical and biological agents is attached to the frame. An airtight floor (18) is attached to the cover material (11) so that the shelter (10) can be pressurized to a pressure of about one inch water gauge above ambient pressure, to prevent reverse air flow of contaminated air into the shelter (10). A blower (20) for pressurizing the shelter (10) and a filter (22) capable of filtering out chemical and biological agents are connected to the shelter (10). The shelter (10) incorporates an internal chamber (26) which serves as a protective air lock entrance and purge chamber and contains an indicator (30) showing when the air lock (26) has been purged and it is safe to enter main chamber (28) of the shelter (10). Air lock (26) is pressurized to one-half inch water gauge above ambient pressure to prevent air flow for air lock (26) into main chamber. The main chamber (28) is equipped with a pressure sensing device (52) and indicator lights (54, 56, 58) indicating either high, correct, or low pressure in the shelter (10) and an audible warning device (60) to warn of dangerously low pressure within the shelter (10).

15 Claims, 12 Drawing Figures

PRESSURE SENSING DEVICE
29
ENTER
42
WAIT
40
PRESS TO PURGE
38
PURGE INDICATOR
46
45
31
HIGH PRESSURE
34
PRESSURE OK
32
LOW PRESSURE
36
30

74
80
84
84
82
63
84
84
76
78

62
ON
OFF
ALARM
54
HIGH PRESSURE
56
PRESSURE OK
58
LOW PRESSURE
60
ALARM
50
PRESSURE SENSING DEVICE
52

EXPANDABLE SHELTER SYSTEM PROVIDING COLLECTIVE PROTECTION

This application is a continuation-in-part of U.S. Pat. Application Ser. No. 06/480,230 filed Mar. 30, 1983, now abandoned.

TECHNICAL FIELD

The present invention relates generally to portable shelters and more particularly to a metal frame, soft side, expandable shelter which is sturdy, self-contained, quickly erectable and strikable, and provides protection against chemical and biological agents and nuclear fallout.

CROSS REFERENCE TO RELATED APPLICATIONS

This application is related to U.S. patent application Ser. No. 611,851, filed May 18, 1984, which was a continuation-in-part of U.S. patent application Ser. No. 525,001, filed Aug. 19, 1983, which was a continuation-in-part of U.S. patent application Ser. No. 410,521, "Expandable Soft Side Shelter," filed Aug. 23, 1982, now abandoned.

BACKGROUND OF THE INVENTION

In the past, a wide variety of portable shelters have been used to include tents and similar structures, inflatable structures, geodesic domes, and various types of prefabricated structures. Tents have the advantage of being quick to erect, while pre-fabricated structures have the advantage of being sturdier, more permanent, and more capable of withstanding weather. The ideal portable shelter would be free-standing and quick and easy to erect, yet sturdy and capable of withstanding windy and stormy weather. Portable shelters, at least those used by the military services, would preferably have one further characteristic: they would provide protection not only against the weather, but also optionally provide protection against chemical and biological agents and nuclear fallout. None of the known prior art devices disclose a portable shelter having these ideal characteristics.

U.S. Pat. No. 3,666,174 to Brylka at et discloses a blower apparatus for air supported structures. The Brylka device is a larger trailer which contains a blower and filters for a double walled air-supported structure. The Brylka device has the same disadvantages as all air-supported structures, that is, a blower must be operating and consuming power constantly to keep the shelter erect. In addition, the requirement for operating a gasoline engine or electric generator at all times reduces its usefulness for military units operating in forward areas in a combat situation.

Another double wall shelter is disclosed in U.S. Pat. No. 2,649,101 to Suits. This shelter is also a pressure supported structure in that it uses a negative pressure to create rigid arches to support the structure. It consists of a double-wall shelter that is inflated only to create the desired shape, then the space between the walls, which has a blanket of insulating material, is evacuated to compress the insulating material and create a rigid arch. The inflating air can then be turned off and the structure will support itself as long as the arches remain under sufficient negative pressure.

A third prior art patent, U.S. Pat. No. 3,660,951 to Cadwell, shows a double walled air-inflated shelter protecting against shock waves from nuclear explosion. A triple wall structure that has varying degrees of pressurization is used to reflect and offset the shock wave pressure. Obviously, the pressures discussed in this patent are orders of magnitude higher than the pressure used for protection of personnel from contaminants. Moreover, this is not a portable shelter of the type contemplated by the present invention.

Another prior art device is U.S. Pat. No. 3,006,352 to Hozak, which discloses and claims a Door Frame and Roll-up Door Mechanism for Air Locks. The Hozak device is an air supported structure which has a frame *inside* the cover of the structure. The frame supports the cover of the structure when the pressure in the structure drops below ambient pressure. This device is a relatively inefficient and low pressure structure which does not have and does not need or suggest many of the features and capabilities of the present invention, as will be shown below.

Still another prior art device is U.S. Pat. No. 2,910,994 to Joy. This patent discloses a very low pressure, air supported structure which has no frame or supports. As in the case of the Hozak patent mentioned above, the Joy patent is a portable shelter but otherwise bears little similarity to the present invention, which has a number of features and capabilities not found in the Joy device. The Joy device suffers from the known inefficiences and disadvantages of conventional air supported structures, as will be shown and discussed more fully below.

Yet another prior art patent is U.S. Pat. No. 1,326,011 issued by Great Britain to Andrews. This British patent has a frame which, at first glance, bears some similarity to the frame of the present invention but yet is quite different, as an examination of the Andrews structure will show. In Andrews, the framework is *inside* the cover as in Hozak, while the present invention has a support framework which is *outside* the cover, making the present invention much more useful as a portable, quickly erectable and strikable shelter. The Andrews patent is nt pressurized and is a much less sophisticated structure than the present invention. It does not need and does not show or suggest many of the advanced features of the present invention and needed by the present invention in order to provide a lightweight portable shelter which protects military personnel and others against chemical and biological agents and against nuclear fallout, as will be disclosed in detail below.

Therefore, it is a general object of this invention to provide a lightweight, sturdy, free-standing, quickly erectable and strikable all-purpose utility structure which also provides protection against chemical and biological agents and nuclear fallout.

It is another object of this invention to provide a lightweight portable shelter having a very lightweight cover made of chemical agent resistant material.

It is a further object of this invention to provide a lightweight, free-standing portable structure which is substantially air tight and with a filtered air pressure source for pressurizing the main chamber of the shelter to a pressure sufficient to prevent reverse air-flow of contaminated air into the structure but not high enough to deform the integral fabric floor of the shelter.

SUMMARY OF THE INVENTION

The present invention is suitable for a wide variety of recreational, military, and business uses whenever a sturdy yet quickly erectable portable shelter is needed. This shelter is, of course eminently suitable to a large number of uses by the military services, including personnel quarters, command and administrative quarters, vehicle and weapons maintenance, storage of supplies, and for field hospitals. The present shelter is designed to also provide whenever needed the additional capability of collective protection against chemical and biological agents and against nuclear fallout.

In accordance with the invention, there is provided an expandable utility shelter comprising a plurality of inverted U-shaped structural rib members aligned in a parallel relationship with a series of reinforcing members connecting each adjacent pair of ribs on each side of the shelter. A substantially air tight enclosure, enclosing a main chamber of the shelter, is attached to the inside of the rib members, said enclosure comprising (1) A flexible cover comprising a chemical agent resistant material attached to the rib members and (2) an integral fabric floor attached to the flexible cover. A pressurizing means is connected to the flexible cover for optionally pressurizing said main chamber of said shelter to a pressure substantially one inch water gauge more than ambient pressure, said pressurizing means comprising power means for optionally turning on and operating said pressurizing means to insure that, when said pressurizing means is turned on, air enters said shelter only from said pressurizing means and that all other air flow is out of said shelter.

BRIEF DESCRIPTION OF THE DRAWINGS

A presently preferred embodiment of the invention will now be described in detail in connection with the accompanying drawings, wherein.

DETAILED DESCRIPTION OF THE INVENTION

Figure 1:
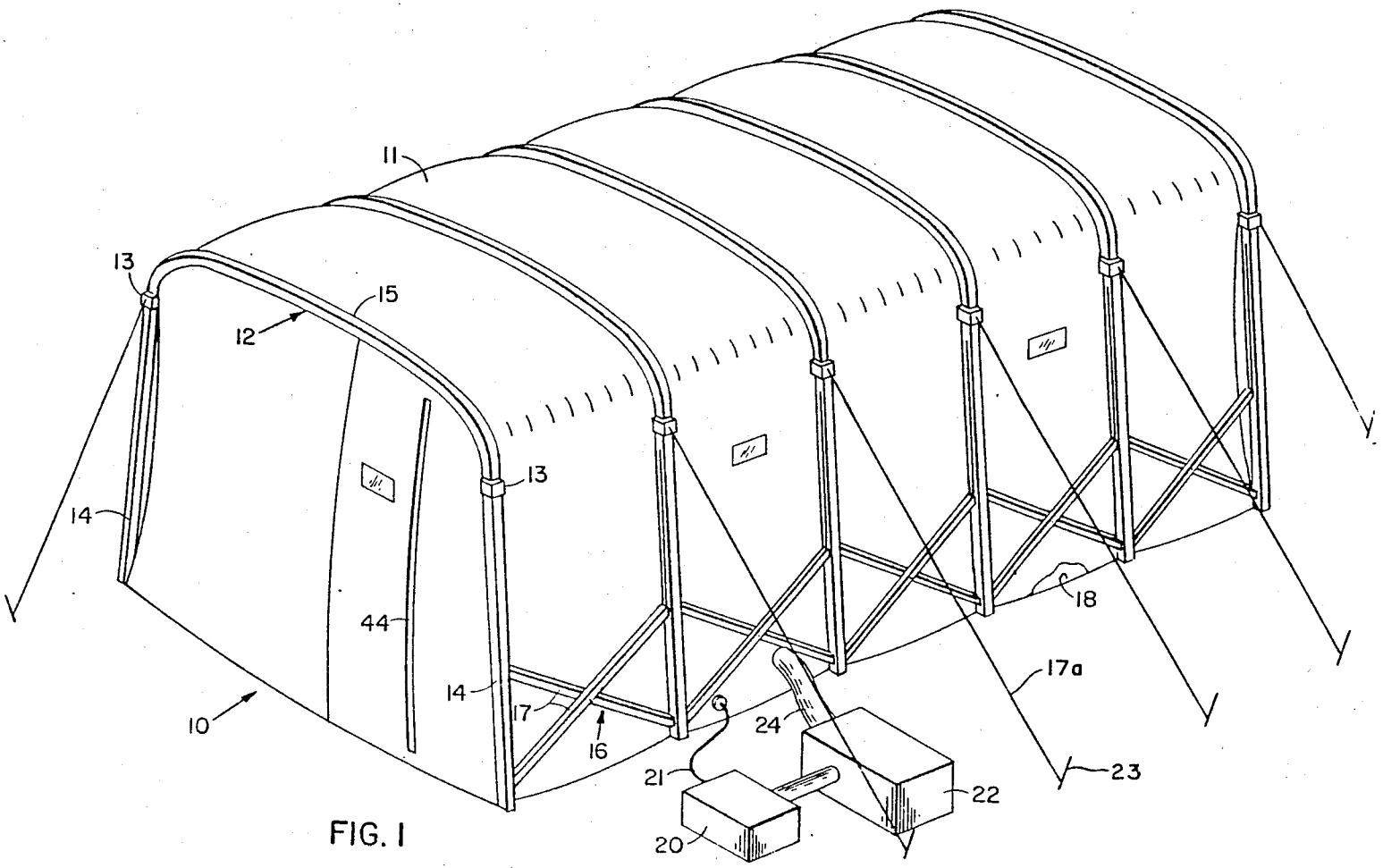
FIG. 1 is a perspective view of the shelter.

FIG. 1 shows a preferred embodiment of the present invention, indicated generally by numeral 10, which is an improved version of the low cost and lightweight, yet sturdy expandable free-standing shelters, which were disclosed fully in U.S. patent application Ser. No. 611,851, filed May 18, 1984, which was a continuation-in-part of the U.S. patent application 525,001, filed Aug. 19, 1983, as mentioned above. The present invention retains other features which were disclosed in the earlier applications, namely, features which make the shelters easily repairable and capable of being connected together to form complexes. The present invention is a modification of the above-mentioned invention in that the present invention also provides protection against chemical and biological agents and protection from nuclear fallout. The present invention has a fabric cover assembly 11 which incorporates the "chemical and biological resistant camouflage material" of the type which was disclosed and claimed in U.S. patent application Ser. No. 309,899, filed Oct. 9, 1981, now U.S. Pat. No. 4,442,162 dated Apr. 10, 1984. This material, in addition to being resistant to chemical and biological agents, is also resistant to and provides protection against nuclear fallout.

As may be seen in FIG. 1, the present invention has a plurality of inverted U-shaped rib members 12 which are equidistantly disposed longitudinally in a column. Ribs 12 may be pushed together to strike the shelter and may be pulled apart to extend the expandable shelter to its full size. In the embodiment of the shelter shown in FIG. 1, each rib 12 comprises two joints 13, two leg members 14, and one top member 15. Also in this embodiment of the invention, adjacent rib members 12 are interconnected and spaced on each side of the shelter by X-shaped reinforcing members 16. Reinforcing members 16 are formed by two reinforcing bars 17 pivotally connected together at their centers.

The entire shelter unit is totally enclosed with an integral cover assembly 11 and air-tight floor 18 which permit shelter 10 to be pressurized by a blower unit 20 having power cord 21. Blower 20 may be operated on an optional basis as desired by simply plugging in (or unplugging) power cord 21 to a suitable power source. Power cord 21 may if desired be equipped with a line cord switch (not shown). Windows, entranceways, and other closures rae also made air-tight through the use of wide mohair fasteners or double- or triple-sewed seams. Blower unit 20 is connected to a gas particulate filter unit (GPFU) 22, which in turn is connected directly to the flexible cover system 11 by duct 24. CPFU filter 22, a known type of filter, provides protection against both liquid and gas chemical agents.

Figure 2:
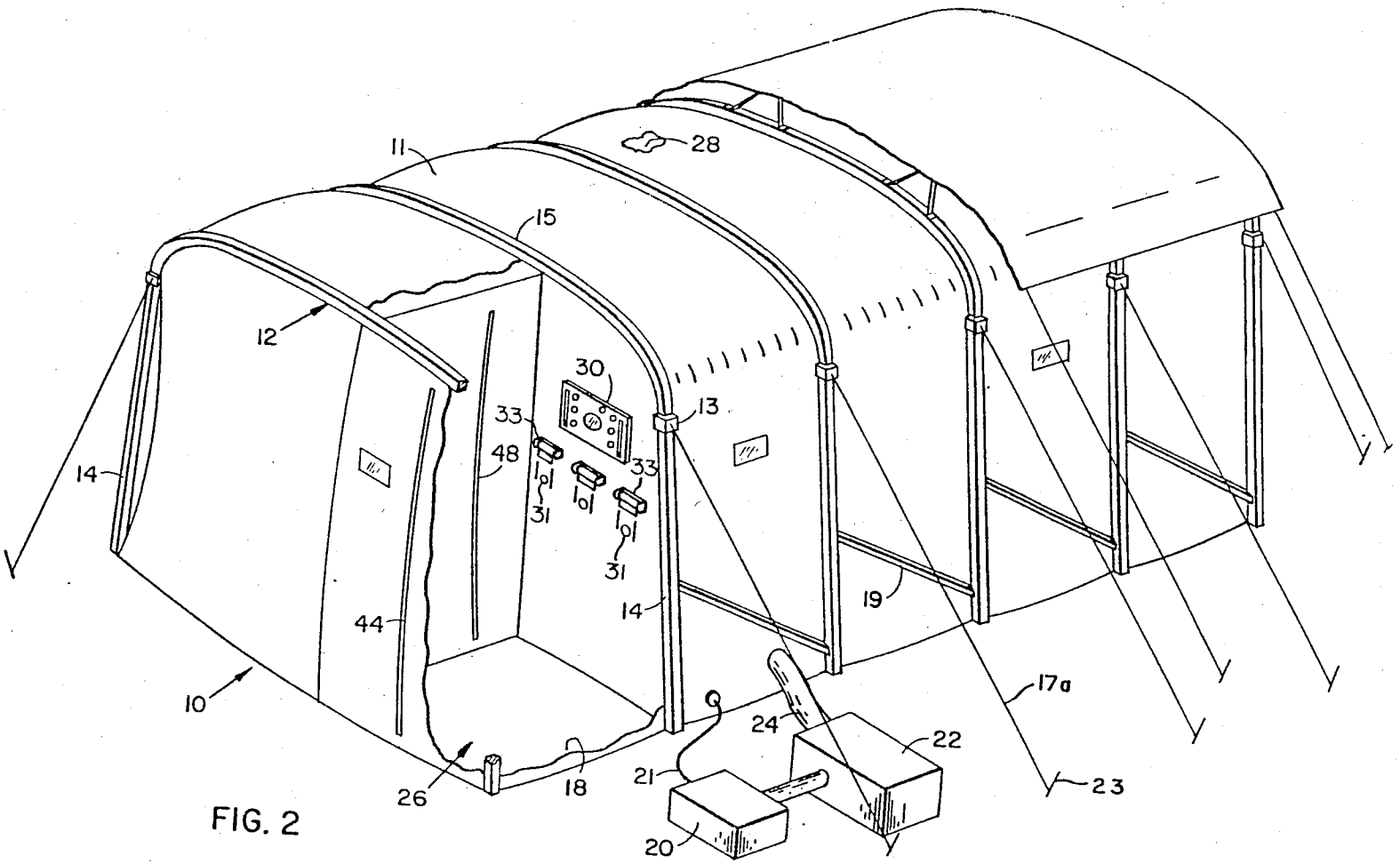
FIG. 2 is a perspective view of an alternative embodiment of the shelter having single reinforcing members and equipped with a fly, one corner of the shelter being cut away to show the air lock.

FIG. 2 shows an alternate arrangement for interconnecting and spacing rib members 12 utilizing single reinforcing members 19 which provide a shelter structure which is lighter in weight than the arrangement shown in FIG. 1, yet is sturdy enough to remain servicable over a long period of time.

As may be seen in the cut-away portion of FIG. 2, shelter 10 incorporates an internally sectioned area 26 which serves as a protective entranceway. This area, which is located in one corner of shelter 10, serves as both an air lock and a purge chamber. As may be seen readily by those skilled in the art, this internally-sectioned airlock 26 fits within the overall rectangular outline of the shelter 10 and therefore presents a better, more integrated appearance than is presented by some prior art shelters having an external, "tacked-on" airlock. Designed leakage from the main chamber 28 causes this purge chamber (or air lock) 26 to be pressurized at a value less than the main chamber 28 of shelter 10 but still above ambient pressure. This designed leakage from the main chamber 28 to the air lock 26 is accomplished by one or more pressure leakage holes 31 in the wall of air lock 26. The amount of leakage out of holes 31 may be adjusted by use of fabric flaps 33, which may be used to cover or partially cover holes 31. Thus, the pressure in air lock 26 may be adjusted as desired to be kept above ambient pressure. It has been found that a design pressure of substantially 1.0 inches water gauge (IWG) in main chamber 28 and substantially 0.5 IWG in air lock 26 provides shelter 10 with near optimum pressurized protection. Incoming persons may enter purge chamber 26 and wait for the clean air flow to purge the contaminants out of the chamber before entering main chamber 28 of shelter 10. The arrangement described above unitizes the entry chamber (air lock) 26 and main chamber 28 of shelter 10 into a single air tight enclosure attached to the inside of the rib members 12. The air-tight enclosure, which is one large fabric cover assembly, comprises a flexible fabric cover 11 attached to ribs 12 and an integral fabric floor 18 attached to the cover 11.

In attaching fabric cover assembly 11 to ribs 12 of the present invention, the fabric along the legs of ribs 12 is not attached to legs 14 as was disclosed in the earlier patent application. This is to enhance the folding characteristics of shelter 10 since a shelter with fabric attached to the legs is incapable of folding properly when it also has a permanently attached floor, as is required in the present invention. When the present invention is erected, fabric 11 is temporarily attached to legs 14 of ribs 12 and floor 18 of the shelter is tangent to the inside of legs 14 as shelter 10 is staked down. Staking the shelter down, using guy ropes 17*a* and stakes 23 is necessary to prevent the internal positive protective pressure from ballooning fabric floor 18, which would lift the framework off the ground and reduce the usable floor space.

At this point, the difference between air-supported structures, such as shown in U.S. Pat. No. 3,006,352 to Hozak and U.S. Pat. No. 2,910,994 to Joy (both described previously), and pressurized structures, such as the present invention, should be explained. Air supported structures are not substantially air tight and are not designed to be so. On the contrary, this type of structure is relatively leaky but is supported by a very slight pressure above ambient pressure (about 0.1 inch water gauge or less) and also by considerable air flow from inside to outside, provided by an air compressor which must run constantly to maintain the pressure and air flow. This arrangement is relatively inefficient because of the amount of work the compressor must do to maintain the air flow. See Joy, column 2, lines 47–59, where Joy explains that his structure is not substantially air-tight and is not designed to be. Joy also explains that the pressure required to support his structure is only 1/500 (or 0.002) p.s.i. Hozak, being an air supported structure, also has similar pressure parameters, as discussed above. For these reasons, Joy and Hozak are not "pressure chambers" or pressurized structures in the same sense as in the present invention, as will be discussed below.

The present invention, on the other hand, is much more efficient because it is comparatively air tight and maintains considerably higher pressure. For example, in the present invention, the pressure in the main chamber of the shelter is designed to be pressurized to about 1 inch water gauge (about 1/27 p.s.i.) above the ambient pressure, a pressure approximately 10 to 15 times as great as the pressure maintained in typical air supported structures (about 0.1 inch water gauge or less or about 1/270 p.s.i. or less). The significance of this considerable difference in the pressure maintained in the present invention is that it eliminates any reverse flow of outside "contaminated" air into the structure, whereas the pressure maintained in the above-mentioned, typical, air-supported structures is insufficient to do this. Thus, air supported structures have some backflow of outside air into the structure and thus could not effectively keep out chemical and biological agents, as the present invention is designed to do.

Figures 3, 4, 6:
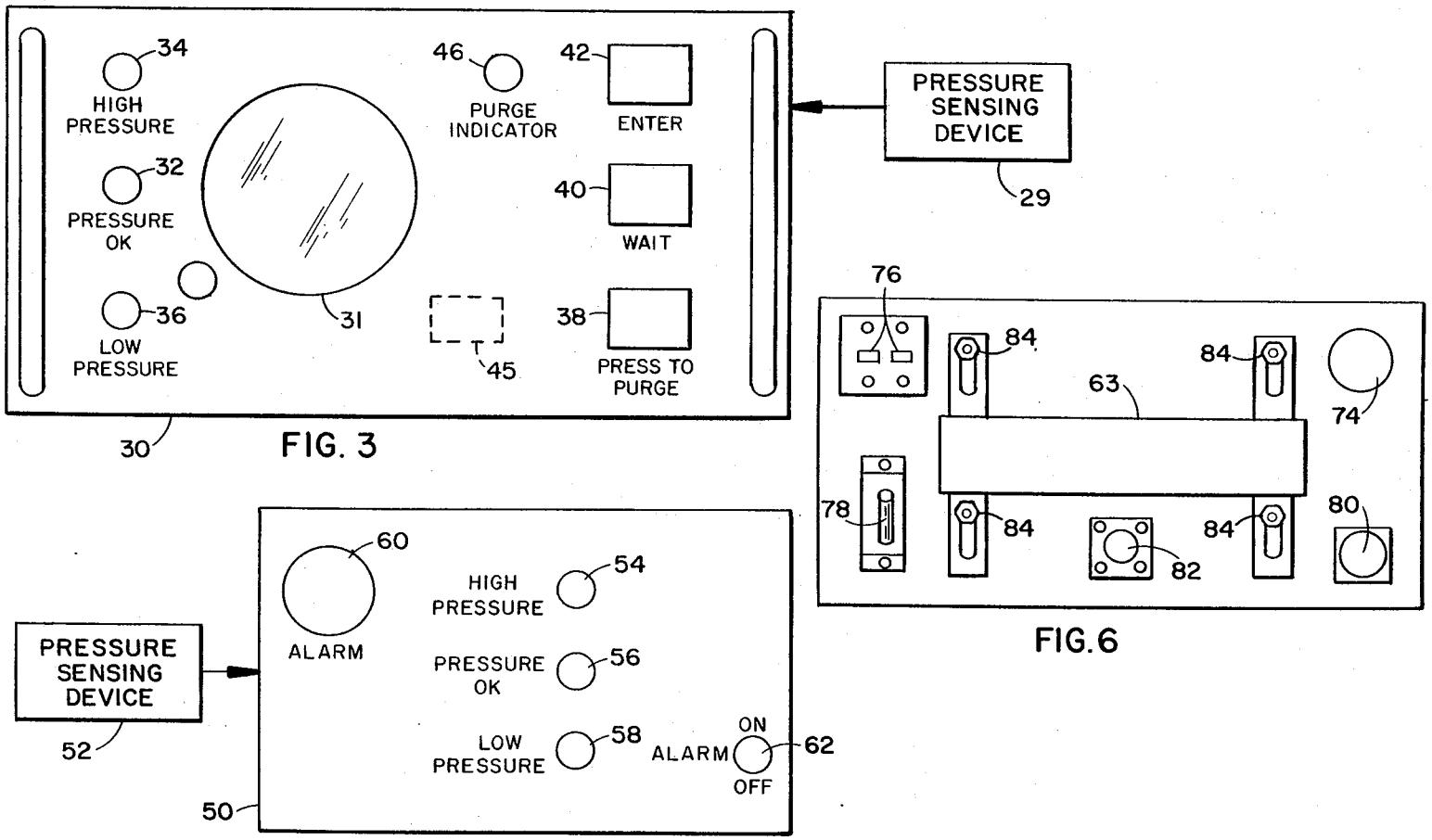
FIG. 3 shows the indicator panel for the airlock.
FIG. 4 is a block diagram of the indicator circuit and panel for the main chamber of the shelter.
FIG. 6 shows the indicator panel for the universal power supply.

FIG. 3 shows a pressure sensing device 29 and an indicator panel 30 for the purge chamber mounted on the partition between the purge chamber 26 and the main chamber 28 and having a window 31 allowing a person in the purge chamber 26 to see into the main chamber 28. On the left side of panel 30 are three indicator lights (32, 34, 36) showing whether the pressure inside the purge chamber of the shelter is O.K., high, or low. High pressure and O.K. indicator lights 34 and 32 are yellow and green, respectively, while a red indicator light 36 warns of low pressure. On the right hand side of the purge chamber panel is a blue-colored button 38 marked "press to purge", a red light 40 indicating "wait" and a green light 42 indicating "enter". When a person enters purge chamber 26, he closes the outer door 44 and pushes "press to purge" button 38. "Wait" light 40 comes on and a timer 45 mounted behind panel 30 starts timing the purge cycle, which involves waiting the necessary elapsed time until the air in purge chamber 26 has been completely purged of contaminants. At the end of the proper present time interval, which may involve two minutes or more, "wait" light 40 turns off and "enter" light 42 is turned on. At the same time, audible signal device 46 sounds, to provide an additional indication that it is now safe to enter the main chamber 28. The person may then open door 48 into main chamber 28 of the shelter and enter. Even when door 48 between air lock 26 and main chamber 28 of shelter 10 is opened for a short period of time, any possible contaminants present in air lock 26 will not enter main chamber 28 of the shelter. This is because air lock 26 is arranged to be pressurized above ambient pressure but below the pressure of main chamber 28 of shelter 10.

On a wall of main chamber 28 of shelter 10 is an indicator panel 50 which indicates the pressure range in the chamber. As may be seen in FIG. 4, indicator panel 50 (which is operatively connected to a known type of pressure sensing device 52) has three indicator lights 54, 56, and 58, one of which will normally be on at a given time. Yellow indicator light 54 indicates "high pressure", green indicator light 56 indicates "pressure O.K.", while red indicator light 58 comes on if the pressure drops down to "low pressure." In addition to these visual indicators, an audible alarm 60 will provide a warning of "low pressure." The alarm may be switched on or off by double-throw, single pole switch 62. Thus, pesons who are working or sleeping in the shelter will be warned of dangerously low pressures which would no longer provide adequate protection against chemical or biological agents. However, switching off alarm 60 by the use of switch 62 enables usage of the shelter in the unpressurized mode without the annoyance of having the alarm sound when it is not needed.

One important feature of the invention is the coupling of pressure sensor 29 with the purge timer 45 (FIG. 3). This feature causes timer 45 to be reset to zero if the pressure in the purge chamber 26 drops to the low range during the purging cycle, thus preventing a false "purge complete" signal when improper purging pressures are present.

When shelter 10 is being used with the option to provide protection against chemical and biological agents, blower 20 must operate, which requires a source of electrical power for the system. To make the shelter system extremely versatile so that it may operate under widely varying conditions, a universal power supply was developed and made part of the system. The system operates on 28 volts, D.C., which is the typical vehicular power presently available. However, the power supply will also utilize various other power inputs as follows: 110 volt 60 Hertz A.C. or 220 volt 60 Hertz A.C. from U.S. commerical power lines or small generators, 230 volt 50 Hertz A.C. from European or other foreign commercial power lines, or 208 volt 400 Hertz A.C. aircraft power or U.S. Air Force A.C. generator. This system may be separately packaged as a blower which would supply air flow to a separate filter or designed into a unitized filter/blower unit.

The capability of utilizing different power supplies is accomplished by providing the air flow with 28 volt D.C. blower motors. A single transformer 63 with a split primary and a 208 volt tap is used to transform the other power supplies to 28 volts. The means of switching from one power supply to another is automatically accomplished by the power cord used. A different power cord is supplied for each power supply. The 110 volts 60 Hertz power cord has a standard 110 volt plug on the end and when connected to the unit automatically makes the proper connections to operate on 110 volt power. In similar fashion, each of the other power cords has a unique plug for that particular voltage. This method of switching eliminates operator error so that the power cords fit only the proper supplied power and make the proper connections to the power supply to operate on that particular power. Thus, the possibility of making improper connections to the power supply is virtually eliminated.

Figure 5A:
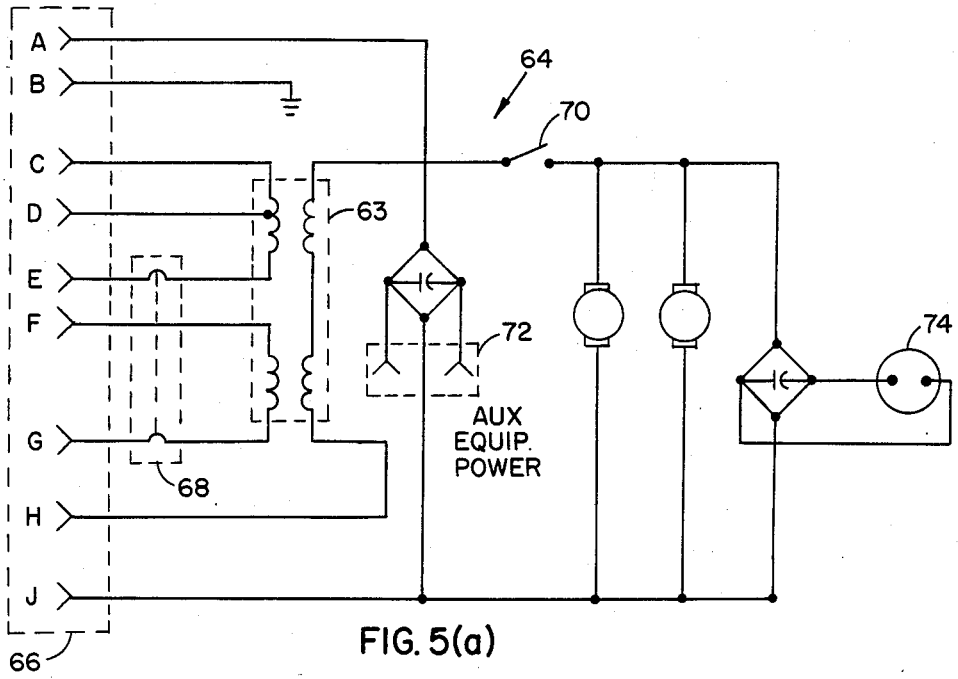
FIG. 5*a* is a circuit diagram of the universal power supply.

Looking now to FIG. 5*a*, a circuit diagram 64 for the universal power supply is shown. Connections for inlet plug 66 are shown on the left side of the diagram. Circuit breakers 68 are shown in the leads marked E and G. An on/off switch 70 is shown at the top of the diagram. Connections for outlet plug 72 are shown in the center of the diagram. An hour meter 74 to register the accumulative running time for the supply is shown at the right hand side of the diagram.

Figure 5B:
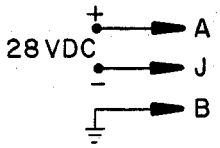
FIG. 5*b* shows input connections for a 28-volt D.C. power cord.
Figure 5C:
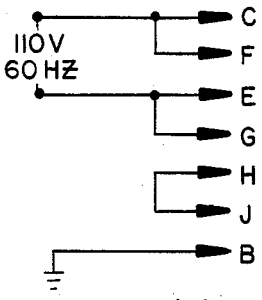
FIG. 5*c* shows input connections for a 110-volt 60 Hertz power cord.
Figure 5D:
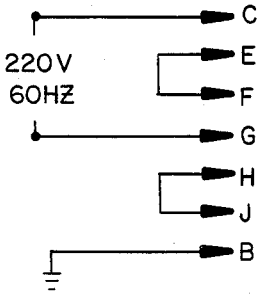
FIG. 5*d* shows input connections for a 220-volt 60 Hertz power cord.
Figure 5E:
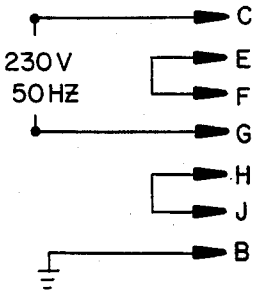
FIG. 5*e* shows input connections for a 230-volt 50 Hertz power cord.
Figure 5F:
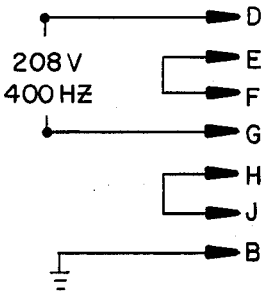
FIG. 5*f* shows input connections for a 208-volt 400 Hertz power cord.

Input connections for the various power cords are shown in FIGS. 5*b*–5*f*, inclusive. FIG. 5*b* shows the input connections for the 28 volt D.C. power cord. FIG. 5*c* shows the input connections for the 110 volt 60 Hertz power cord. FIG. 5*d* shows the input connections for the 220 volt 60 Hertz power cord. FIG. 5*f* shows the input connections for the 208 volt 400 Hertz power cord.

FIG. 6 shows the front panel for the universal power supply. At the upper left side of the panel are shown circuit breaker switches 76. Immediately below the circuit breaker is an on/off switch 78. At the lower right of the panel is a receptacle 80 for inlet plug 66 and at the lower center of the panel is the outlet plug 82. The transformer is mounted on the inside of the panel with four bolts 84 which show in the center of the panel. Hour meter 74, which shows the accumulated running time for the unit, is shown at the upper right portion of the panel.

Figure 7:
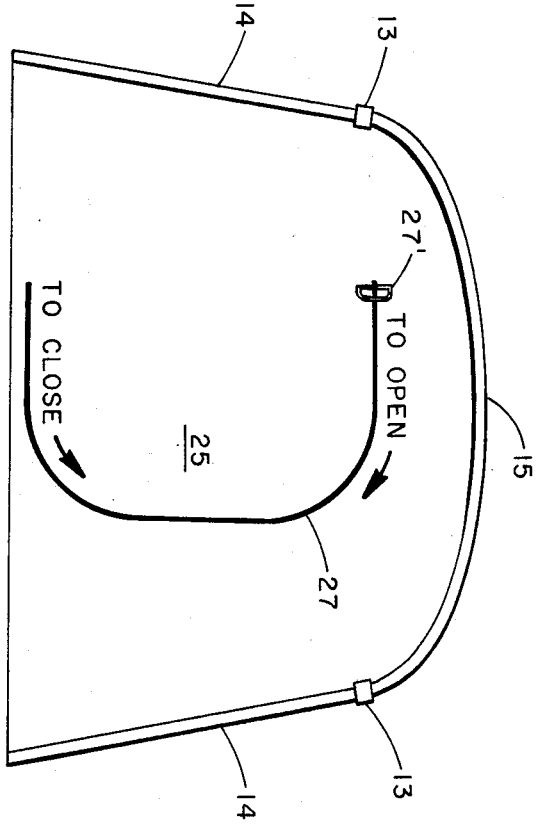
FIG. 7 shows one end of the shelter, as viewed from the inside of the shelter, with the emergency exit door visible.

FIG. 7 shows the rear end of the shelter, as viewed from the inside of the shelter. The present invention is equipped with an emergency exit door 25 having a zipper fastening 27 which is operable only from the inside of the main chamber of the shelter. Obviously, this door 25 may take several different configurations. However, in the preferred embodiment of the invention, this emergency door 25 is a "D" shaped zippered closure 27 in the center of the rear end of the shelter. This allows the occupants of the shelter to exit fast in case of an emergency, but prevents accidental opening of the shelter which would result in depressurization of the chamber with possible danger to the occupants. To open the emergency door 25, zipper handle 27' is pulled to the right, then down, and then to the left.

As herein disclosed, the present invention relates to a greatly improved expandable utility structure which is free-standing, sturdy, light in weight, easy to manufacture, easy to repair, quickly erectable and strikable, yet provides collective protection against chemical and biological agents and against nuclear fallout. The device has the advantage that it may be utilized as a portable, expandable shelter for conventional uses without the need for a blower or other devices requiring electrical power, yet may be used to provide collective protection when needed.

We claim:

1. An expandable, free-standing, portable, quickly erectable and strikable, utility shelter with an outside support framework and providing collective protection against nuclear fallout and optional protection against chemical and biological agents comprising:

a plurality of inverted U-shaped structural rib members in a parallel relationship, each of said rib members having a plurality of faces, one of said faces facing toward the inside of said shelter;

a series of reinforcing members, one of said reinforcing members connecting each adjacent pair of ribs on each side of said shelter, said reinforcing members being operative to push said rib members together in abutting relationship or to pull them apart in spaced relationship and to stabilize and maintain parallel physical relationship between said rib members;

a substantially air-tight enclosure attached to said inside faces of said rib members, said enclosure enclosing a main chamber of said shelter and comprising:

a flexible cover attached to said inside faces of said rib members, said cover comprising a chemical agent resistant material; and an integral fabric floor attached to said flexible cover; and a pressurizing means connected to said flexible cover for optionally pressurizing said main chamber of said shelter to a pressure substantially one inch water gauge more than ambient pressure, said pressurizing means comprising power conducting means for optionally turning on and operating said pressurizing means in order to insure that, when said pressurizing means is turned on, air enters said shelter only from said pressurizing means and that all other air flow is out of said shelter, said pressurizing means comprising a blower capable of pressurizing said main chamber of said shelter to a pressure of substantially one inch water gauge and said power conducting means comprising a power line cord which optionally may be plugged into a suitable electric power source;

wherein said shelter has a generally rectangular floor plan and said shelter comprises two internal chambers, the first said chamber being a protective air lock arranged and adapted to function as a purge chamber and the second said chamber being a main chamber arranged and adapted optionally to maintain a clean environment free of chemical and biological agents, said air lock being located in one corner of said shelter, said air lock comprising two doors, one leading to the outside environment and one leading into said clean environment of said main chamber of said shelter, said main chamber comprising an L-shaped chamber;

pressure leakage means connecting said airlock and said main chamber, said pressure leakage means being arranged and adjusted to pressurize said air lock to a pressure substantially one-half inch water gauge above ambient pressure and substantially one-half inch water gauge below the said pressure of said main chamber of the shelter, said pressure leakage means comprising at least one pressure leakage hole mounted in the wall between said air lock and said main chamber, said pressure leakage means comprising a fabric flap mounted over said leakage hole and arranged and positioned so as to be capable of covering said hole optionally; and a purge timer having means for presetting a predetermined purge cycle time and means for timing elapsed time, and an indicator panel mounted in said air lock, said indicator panel comprising audio signal means and visual signal means, said timer being operatively connected to said indicator panel and arranged and adjusted to time said elapsed time a person has been inside the air lock and to cause said indicator panel to provide both an audio signal and a visual signal when said predetermined purge cycle time has elapsed and it is safe to enter the main chamber of the shelter;

whereby said pressurizing means optionally may be turned on and operated when protection against chemical or biological agents is considered necessary or desirable.

2. The shelter of claim 1 comprising a gas particulate filter unit connected to said blower and said flexible cover for filtering out chemical and biological agents and preventing them from entering said shelter.

3. The shelter of claim 1 wherein each said reinforcing member comprises a single reinforcing bar.

4. The shelter of claim 1 wherein each said reinforcing member comprises two reinforcing bars pivotally connected together at their centers to form an X-shaped member.

5. The shelter of claim 1 wherein said visual signal means comprises an indicator light marked "enter" and said indicator panel comprises a pushbutton marked "press to purge" and an indicator light marked "wait", said pushbutton and said indicator lights being mounted on said indicator panel, said pushbutton being operatively connected to said indicator lights and said timer whereby one may enter said chamber and push said pushbutton, thus causing the "wait" indicator light to come on and whereby said timer activates said indicator light marked "enter" and said audio signal means.

6. The shelter of claim 5 comprising a pressure sensing means operatively connected to said indicator panel and wherein said indicator panel comprises three pressure indicating lights marked and arranged so as to indicate high, normal or low pressure in response to pressure sensed by said pressure sensing means in said air lock.

7. The shelter of claim 6 wherein said pressure sensing means is operatively connected to said purge timer and arranged so that said purge timer is reset to zero if the pressure in said air lock drops to the low range during the purging cycle, whereby said indicator panel is prevented from indicating a false signal to enter the said main chamber when improper purging pressures are present.

8. The shelter of claim 7 comprising a pressure monitoring device in the main chamber of the shelter, said pressure monitoring device being connected to an indicator to warn of fluctuation in said pressure in said main chamber.

9. The shelter of claim 8 wherein said indicator comprises a panel and three indicating lights to indicate high pressure, correct pressure, or low pressure.

10. The shelter of claim 9 wherein said indicator panel comprises an audible alarm to indicate low pressure, whereby persons working or sleeping in said shelter will be assured of an immediate warning if the pressure within said shelter drops dangerously low.

11. The shelter of claim 10 comprising a gas particulate filter unit connected to said blower and said flexible cover for filtering out chemical and biological agents and preventing them from entering said shelter.

12. The shelter of claim 11 wherein said shelter has an emergency exit door in said main chamber, said emergency door comprising a zipper closure comprising an attached handle mounted in said flexible cover, said zipper closure handle being operable only from the inside of said main chamber, for preventing accidental opening from the outside and contamination of said shelter.

13. The shelter of claim 12 wherein said emergency exit door is configured with a "D" shaped opening and said zipper closure is arranged and configured so that it may be opened by pulling said zipper handle around said D-shaped opening.

14. The shelter of claim 13 wherein each said reinforcing member comprises a single reinforcing bar.

15. The shelter of claim 13 wherein each said reinforcing member comprises two reinforcing bars pivotally connected together at their centers to form an X-shaped member.

* * * * *